United States Patent [19]

Stevens, Jr.

[11] Patent Number: 4,625,436

[45] Date of Patent: Dec. 2, 1986

[54] CLOGGING DANCE TAP DEVICE

[76] Inventor: Walter T. Stevens, Jr., 105 Fellowship Rd., Moorestown, N.J. 08057

[21] Appl. No.: 748,173

[22] Filed: Jun. 24, 1985

[51] Int. Cl.[4] ..... A43B 5/12

[52] U.S. Cl. ..... 36/113; 36/8.3; 36/139

[58] Field of Search ..... 36/8.3, 113, 139, 114, 36/136; 446/26; 46/175 R

[56] References Cited

U.S. PATENT DOCUMENTS

| | | | |
|---|---|---|---|
| 1,943,222 | 1/1934 | Landi | 36/8.3 |
| 1,997,221 | 4/1935 | Landi | 36/8.3 |
| 2,168,303 | 8/1939 | Sothen | 36/8.3 |
| 4,463,506 | 8/1984 | Isackson | 36/8.3 X |
| 4,468,871 | 9/1984 | Winn | 36/113 X |
| 4,513,519 | 4/1985 | Hedrick | 36/8.3 X |

*Primary Examiner*—Werner H. Schroeder

*Assistant Examiner*—T. Graveline

*Attorney, Agent, or Firm*—Thomas A. Lennox

[57] ABSTRACT

A clogging tapping device for attachment on the heel and sole of shoes to hammer out a lively rhythm while square dancing is provided including a base plate member with a sharp turned-up periphery edge and a plurality of holes through the base plate which allows nails to be hammered through to fix the plate to the shoe, a rounded tapping plate member generally a toe sole shape or a heel shape with an attachment device of at least two rivets to loosely attach the tapping plate to allow it to cant and move to strike the base plate and a plurality of holes through the tapping plate, one each aligned over the holes in the base plate but in this case, the hole being of a size to allow the head of the nail to be force fitted through each hole, where the rivets are rounded and set in depressions of the tapping plate to avoid scarring the floors.

18 Claims, 5 Drawing Figures

CLOGGING DANCE TAP DEVICE

BACKGROUND OF THE INVENTION

This invention involves shoe taps and more particularly jingling clogging taps which hammer out a lively rhythm when attached to shoe soles during a country dance.

Clogging is a traditional dance that is most popular in the midwest and in the southern states of the United States of America. The steps might be generally classified as square dancing with the clogger, male and female, wearing metal rhythm makers on the toe and on the heel of their shoes. As the clogger goes through the square dancing steps, the dancer strikes the heel and the toe on the dance floor as each step is made, hammering a noisy but quite pleasant rhythm. When the cloggers are with the beat, it is the most impressive dance.

Prior commercial clogging devices use cast aluminum plates, one of which is a movable plate attached to the fixed plate usually by a single loose rivet in the middle. The top of the rivet is flat and is at the same plane as the movable plate. Flanges extend upwardly from the base plate along each side to prevent the movable plate from turning about on the rivet. The movable parts are struck together in a manner similar to castanets whenever they strike the floor, producing a loud metallic jingle sound with each strike. Present commercial clogging device tend to break easily and scar the floor due to the sharp edges that result from a break. Scarring also results from the sharp edges of the flat rivet, even when breakage does not occur. The nails may back out and tear up the floor. In addition, the joint, between the base plate flanges and the movable plate of present commercial clogging devices fill in with floor wax, dirt, or tar and quickly become inoperable to sound the jingle.

The following U.S. patents describe tapping devices that do not satisfy the above needs or attain the objects hereinbelow: U.S. Pat. Nos. 1,138,684 to C. D. Neely, 1,738,177 to J. Esmonde, 1,868,765 to F. D. Reynolds, 1,943,222 to E. Landi, 2,059,952 to E. Landi, 2,105,642 to S. Capezio, 2,168,303 to A. L. Sothen, 4,463,506 to D. F. Isackson, and 4,513,519 to G. Hedrick.

SUMMARY OF THE INVENTION

It is an object of this invention to provide clogging devices, attachable to the shoes which stay firmly attached despite hard use.

It is an additional object of the present invention to provide a clogging device which does not scar the floor on which the dance is held.

It is an additional object of the present invention to provide a clogging device which when nailed to the shoe, the nails can not back out and scar the floor.

It is an object of the present invention to provide a clogging device which when attached to the heel or sole, will not crack, will provide no rough edges, and is essentially indestructible providing long wear and service without damage to the surface on which the dance is held.

It is a further object of the present invention to provide a clogging device which resists the collection of foreign materials in the mechanism which prevents the clogging device from jingling after extended use and even on surfaces that yield a "gummy" material depositing on the bottom of the taps.

This invention is a clogging tap device to be attached to the bottom of the heel or the toe or both the heel and the toe of a shoe. The device includes a base plate member having a front end and a back end, the direction between the ends being common to the direction of the length of the shoe or of the center line of the shoe. It is preferred that the base plate member be shaped in the form of a heel or a toe of a shoe to which it is to be fitted. The base plate is supplied with a plurality of holes, preferably about five holes which pass through the base plate, each hole being of a size to allow the shank of a nail or other fastener to fit through, but at the same time prevent the head from passing through. A tapping plate member is provided, preferably shaped to approximate the shape of the base plate and that of the heel or the toe of the shoe sole to which it is attached is provided. A hinge type attachment device including at least two rivet devices is provided to attach the tapping plate to the base plate while allowing the tapping plate to move, canting back and forth toward the front end and the back end. The tapping plate is provided with a plurality of holes through the tapping plate, one each aligned over every hole in the base plate. These holes through the tapping plate are of a size to allow the head of the nail or the fastener to pass through the hole in the tapping plate. It is preferred that these holes be of such size that the head of the nail or the fastener snugly fits or more preferably force fits through the hole in the tapping plate as the base plate is nailed to the sole or heel of the shoe.

It is preferred that the attachment means include at least two second holes through the tapping plate with a depressed area of the tapping plate around each of the second holes, the depression being on the surface away from the shoe bottom. A convex domed area of the tapping plate is provided around each of the second holes, the domed area being on the surface toward the shoe bottom. These domed areas provide a rocking pivot point for the rocking tapping plate. Second holes are provided through the base plate, one each aligned with each second hole through the topping plate and a rivet device is provided through the pairs of second holes to loosely attach and hinge the tapping plate to the base plate, allowing loose canting movement of the base plate front to back along the central axis of the shoe. The second holes are aligned to a line transverse to the central axis of the shoe. It is also preferred that sharp upturned knife-like edges be provided along the periphery of the base plate on the surface to bite into the side or heel of the shoe.

DESCRIPTION OF PREFERRED EMBODIMENTS

Figure 1:
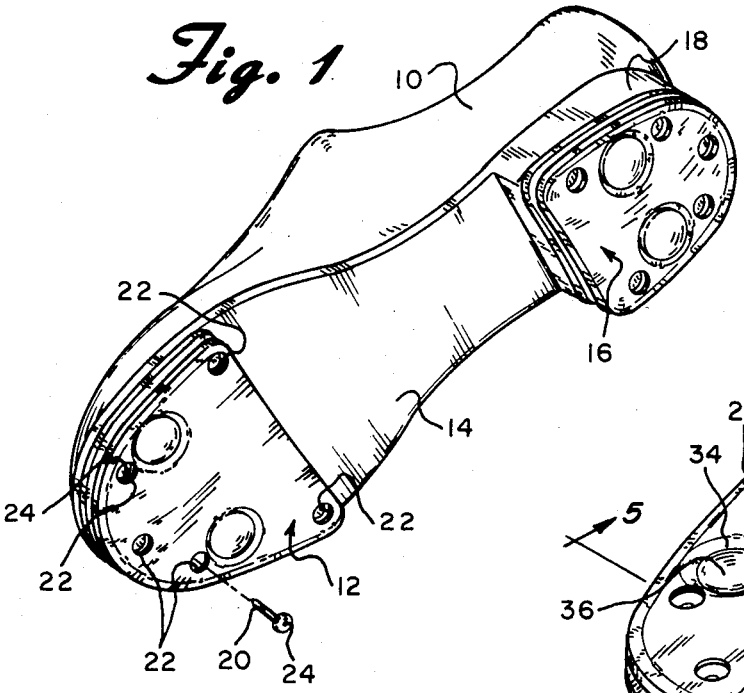
FIG. 1 is a perspective view of the clogging devices of the present invention attached to the bottom of a shoe.

FIG. 1 is a perspective view of shoe 10 to which clogging device 12 is attached to the toe portion of the sole 14 and a similarly constructed clogging device 16 is attached to heel 18. Each clogging device, 12 and 16, is attached to the sole or heel with nails 20 which are inserted through holes 22 and driven into the sole or heel under the device. Holes 22 are sized such that head 24 of nail 20 is snug or even forced fitted through the hole before being driven into the sole.

Figure 2:
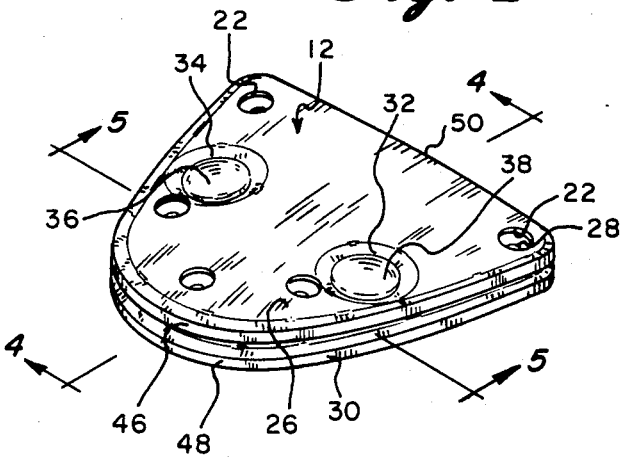
FIG. 2 is a perspective view of a clogging device of the present invention viewing the surface facing downwardly toward the floor.

FIG. 2 is an full sized perspective view of clogging device 12 with holes 22 opening through tapping plate 26 which is cold rolled steel formed slightly convex toward the surface striking the ground. To attach device 12 to the bottom of the shoe, nails 20 are inserted so that the point extends through holes 22 and also through holes 28 which passes through base plate 30, illustrated in FIGS. 2 and 3. When nail 20 is driven and forced fitted through hole 22, it engages the upper surface of base plate 30 as the head is too large to pass through hole 28. Even if nail 20 backs out of its grip on the sole or heel to which it is nailed, it is prevented from passing out through hole 22, thus essentially eliminating any chance of scarring the floor. Tapping plate 26 is formed with concave depressions 32 and 34 which are annular in shape surrounding a second series of holes in plate 26 through which round headed rivets 36 and 38 are fixed. The top of rivets 36 and 38 do not extend pass the floor contacting surface of plate 26 preventing floor scarring. All outside exposed edges of plate 26 are rounded.

Figure 3:
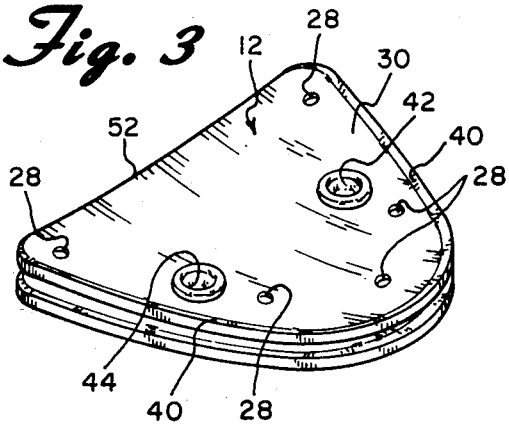
FIG. 3 is a perspective view of the device pictured in FIG. 2 looking at the surface fixed to the bottom of the shoe sole.

FIG. 3 illustrates the bottom of device 12 which is attached to the sole surface of the shoe. Base plate 30 is slightly dish shaped cold rolled steel with the concave surface toward the bottom of the shoe to which it is nailed. Upright sharp edged flange 40 extends around the periphery of the surface facing the shoe sole to engage and lock the plate onto the sole surface. Sharped edged flange 40 bites into the shoe sole or heel surface and reduces the tendency of movement between top 12 and the shoe surface. This removes much of the strain from nails 20 during dancing, and reduces the tendency of the nails to loosen. Holes 28 are of a size such that the head of nails 20 cannot fit through and when driven through the holes into the shoe soles, they fix device 12 to the shoe. End 42 of rivet 36 and end 44 of rivet 38 are crimped over to attach tapping plate 26 to base plate 30. It is important that crimpings 42 and 44 be accomplished to prevent the plates from separating, but not to prevent them from moving against each other. The crimpings are not made down the shank or rivets 36 and 38 to engage the surface of plate 30 so that the plates are not pushed tight together. This attachment is described as "loosely attached" throughout the specification and claims and is intended to denote strong attachment but sufficiently loose to allow rocking movement of tapping plate 26. Thus, crimpings 42 and 44 allow tapping plate 26 to cant along a line joining rivets 36 and 38 such that front end 46 of tapping plate 26 may cant to touch and clank against front end 48 of base plate 30. Likewise, back end 50 is free to cant and strike back end 52 of base plate 30. It is sufficient that plate cant and jingle without necessarily hitting both front and back of loose plate 30.

Figure 4:
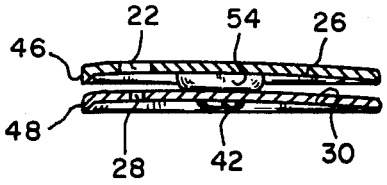
FIG. 4 is a cross-sectional view taken along lines 4—4 of FIG. 2.
Figure 5:
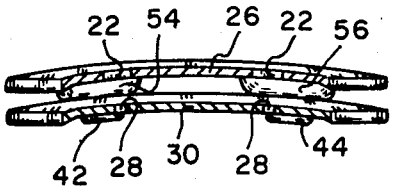
FIG. 5 is a cross-sectional view taken along lines 5—5 of FIG. 2.

FIG. 4 illustrates the dome-like structure 54 which surrounds the hole in plate 26 through which rivet 36 passes crimped over the bottom at 42. Dome shape 54 is formed from the cold rolled steel plate and is depressed at 34 to form a convex downwardly shaped dome 54 between the plates. Since rivet 36 is attached loosely, plate 26 rocks on dome shape 54 allowing front end 46 to strike and jingle against front end 48 of base plate 30. Also dome 54 strikes against plate 26. FIG. 5 illustrates domes 54 and 56 on which tapping plate 26 rocks and jingles. Plate 26 rocks on pivot line joining domes 54 and 56 toward the viewer and away from the viewer.

While this invention has been described with reference to the specific embodiments disclosed herein, it is not confined to the details set forth and the patent is intended to include modifications and changes which may come within and extend from the following claims.

I claim:

1. A tap device to be attached to the shoe bottom surface of at least one of the heel and toe comprising:

(a) a base plate member having a front end and a back end, the direction between the ends being common to the length of the shoe, (b) a plurality of holes through the base plate each hole being of a size to allow the shank of a nail with a head to fit through but to prevent the head from passing through, (c) a tapping plate member substantially the same size as said base plate, (d) attachment means comprising at least two rivet means to attach the tapping plate to the base plate while allowing the tapping plate to move, canting back and forth toward the front end and toward the back end, and (e) a plurality of holes through the tapping plate, one each aligned over every hole in the base plate, each hole being of a size to barely allow the head of the nail to pass through the hole in the tapping plate.

2. The device of claim 1 wherein the base plate member is shaped in the form of at least one of the heel and toe of the shoe.

3. The device of claim 1 wherein the base plate is dished shaped with the concave surface toward the shoe bottom.

4. The device of claim 1 wherein the base plate has an upraised sharp edged flange around the peripheral edge of the base plate surface toward the shoe bottom.

5. The device of claim 1 wherein the tapping plate is dished shaped with the concave surface toward the shoe bottom.

6. The device of claim 1 wherein the holes through the tapping plate are of a size to allow the head of the nail to be forced fitted through the hole.

7. The device of claim 1 wherein the attachment means comprises:

(a) at least two second holes through the tapping plate (b) a depressed area of the tapping plate around each of the second holes, the depressions being on the surface away from the shoe bottom.

(c) a convex domed area of the tapping plate around each of the second holes, the domed area being on the surface toward the shoe bottom, (d) second holes through the base plate, one each aligned with each second hole through the tapping plate, and (e) rivet means to loosely attach and hinge the tapping plate to the base plate through the pairs of second holes while allowing canting movement of the base plate front to back along the direction of the length of the shoe, wherein the second holes are aligned in a line transverse to the length of the shoe.

8. The device of claim 7 wherein the second holes are positioned in a line about median distance between the front end and the back end.

9. A tap device to be attached to the shoe bottom surface of at least one of the heel and toe comprising:

(a) a base plate member having a front end and a back end, the direction between the ends being common to the length of the shoe, (b) shoe attachment means to firmly fix the base plate to the bottom surface of the shoe, (c) a tapping plate member substantially the same size as said base plate, (d) attachment means to loosely attach the tapping plate to the base plate, and (e) a rocking pivot raised area means between the base plate member and the tapping plate member allowing the tapping plate to cant back and forth on the pivot means toward the front end and toward the back end.

10. The device of claim 9 wherein the rocking pivot means comprises at least two dome-like convex raised areas on the tapping plate member.

11. The device of claim 9 wherein the base plate member is shaped in the form of at least one of the heel and toe of the shoe.

12. The device of claim 9 wherein the base plate is dished shaped with the concave surface toward the shoe bottom.

13. The device of claim 9 wherein the base plate has an upraised flange around the peripheral edge of the base plate surface toward the shoe bottom.

14. The device of claim 9 wherein the tapping plate is dished shaped with the concave surface toward the shoe bottom.

15. The device of claim 9 wherein the attachment means comprises:

(a) at least two second holes through the tapping plate (b) a depressed area of the tapping plate around each of the second holes, the depressions being on the surface away from the shoe bottom.

(c) a convex domed area of the tapping plate around each of the second holes, the domed area being on the surface toward the shoe bottom, (d) second holes through the base plate, one each aligned with each second hole through the tapping plate, and (e) rivet means to firmly attach the tapping plate to the base plate through the pairs of second holes while allowing canting movement of the base plate front to back along the direction of the length of the shoe, wherein the second holes are aligned in a line transverse to the length of the shoe.

16. The device of claim 15 wherein the second holes are positioned in a line about median distance between the front and the back end.

17. The device of claim 15 wherein the holes through the tapping plate are of a size to allow the head of the nail to be forced fitted through the hole.

18. A clogging tap device to be attached to the bottom surface of at least one of the heel and toe of a shoe comprising:

(a) a base plate member having a front end and a back end, the direction between the ends being along the center line along the length of the shoe, the base plate member being dished shaped with the concave surface toward the shoe bottom and having a sharp upraised flange around the peripheral edge of the base plate surface facing toward the shoe bottom so as to embed in the sole when attached, (b) a plurality of holes through the base plate, each hole being of a size to allow the shank of a nail with a head to fit through, but prevent the head from passing through, (c) a tapping plate member having a convex surface on the non-ground contacting surface of the tapping plate member, (d) attachment means for attaching the tapping plate member to the base plate member comprising, (i) at least two second holes through the tapping plate, (ii) a depressed area of the tapping plate around each of the second holes, the depression being on the ground contacting surface of the tapping plate, (iii) a convex domed area of the tapping plate around each of the second holes, the domed area being the surface toward the shoe bottom, (iv) second holes thorugh the base plate, one of each aligned with each second hole through the tapping plate, and (v) rivet means for each second hole to loosely attach and hinge the tapping plate to the base plate, but allowing canting movement of the base plate front to back along the length of the shoe, wherein the second holes are aligned in a line transverse to the center line of the shoe, and (e) a plurality of holes through the tapping plate, one each aligned over every hole in the base plate, each hole in the tapping plate being of a size to allow the head of the nail to barely pass through the hole in the tapping plate.

* * * * *